US008771588B2

(12) United States Patent
Langevin et al.

(10) Patent No.: US 8,771,588 B2
(45) Date of Patent: Jul. 8, 2014

(54) DEVICE FOR BLOWING GAS ONTO A FACE OF TRAVELING STRIP MATERIAL

(75) Inventors: Stéphane Langevin, Saint-Fargeau-Ponthierry (FR); Patrick Dubois, Andrezel (FR)

(73) Assignee: CMI SA, Seraing (BE)

( * ) Notice: Subject to any disclaimer, the term of this patent is extended or adjusted under 35 U.S.C. 154(b) by 231 days.

(21) Appl. No.: 12/988,614

(22) PCT Filed: May 7, 2009

(86) PCT No.: PCT/FR2009/000537

§ 371 (c)(1), (2), (4) Date: Oct. 19, 2010

(87) PCT Pub. No.: WO2009/138602

PCT Pub. Date: Nov. 19, 2009

(65) Prior Publication Data

US 2011/0030820 A1 Feb. 10, 2011

(30) Foreign Application Priority Data

May 13, 2008 (FR) ..... 08 02579

(51) Int. Cl.
*F27B 15/00* (2006.01)

(52) U.S. Cl.
USPC ..... 266/251

(58) Field of Classification Search
USPC ..... 266/46, 113, 251, 87, 90, 259; 148/660, 148/661; 34/611, 114, 570
See application file for complete search history.

(56) References Cited

U.S. PATENT DOCUMENTS

| | | | | |
|---|---|---|---|---|
| 4,041,895 | A * | 8/1977 | Overton et al. | 118/704 |
| 6,054,095 | A * | 4/2000 | Minato et al. | 266/81 |
| 6,309,483 | B1 * | 10/2001 | Wang et al. | 148/661 |

FOREIGN PATENT DOCUMENTS

| | | | | |
|---|---|---|---|---|
| DE | 31 46 656 | A1 | 6/1983 | |
| GB | 2 096 490 | A | 10/1982 | |
| JP | 57-171626 | | 10/1982 | |
| JP | 57171626 | * | 10/1982 | B21B 45/02 |
| JP | 58-185717 | | 10/1983 | |
| JP | 61-257429 | | 11/1986 | |
| JP | 61257429 | * | 11/1986 | C21D 9/573 |
| JP | 63-77564 | | 4/1988 | |

* cited by examiner

*Primary Examiner* — Scott Kastler
*Assistant Examiner* — Michael Aboagye
(74) *Attorney, Agent, or Firm* — Muncy, Geissler, Olds & Lowe, P.C.

(57) ABSTRACT

A device for blowing gas on a face of traveling strip material, comprising at least one hollow box having its wall fitted with a plurality of blow orifices, thereby enabling gas to be directed towards said face of the strip material. The hollow box is also fitted laterally on at least one side thereof relative to a midplane (Q) perpendicular to the plane in the strip with a movable shutter member having the function of selectively shutting some of the blow orifices. In order to adapt the width of the blow zone to the width of the corresponding strip material, said movable shutter member has an edge adjacent to the inside surface of the wall fitted with the blow orifices, and an edge adjacent to a side wall of the hollow box.

11 Claims, 4 Drawing Sheets

Fig.7A
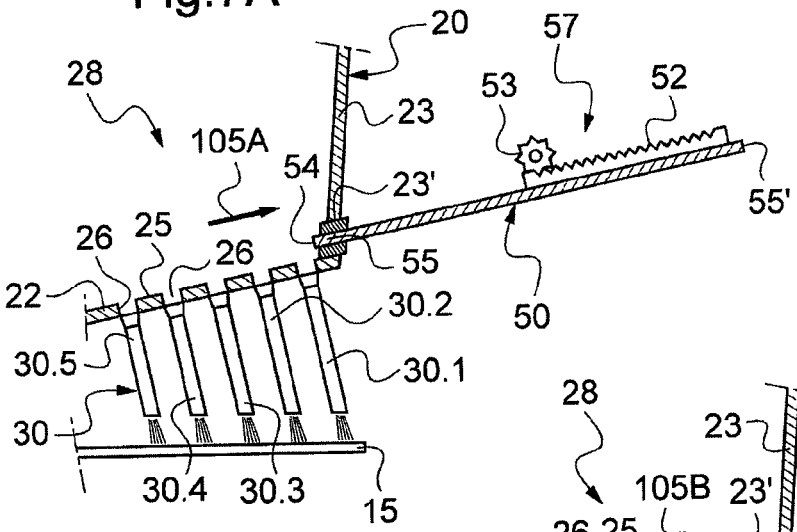
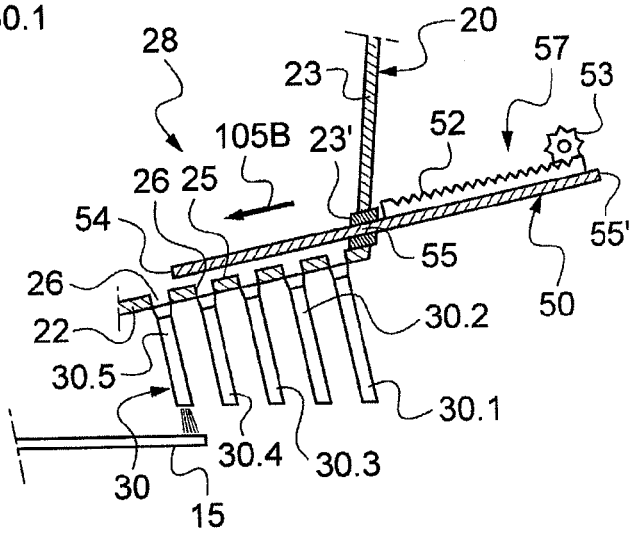
Fig.7B
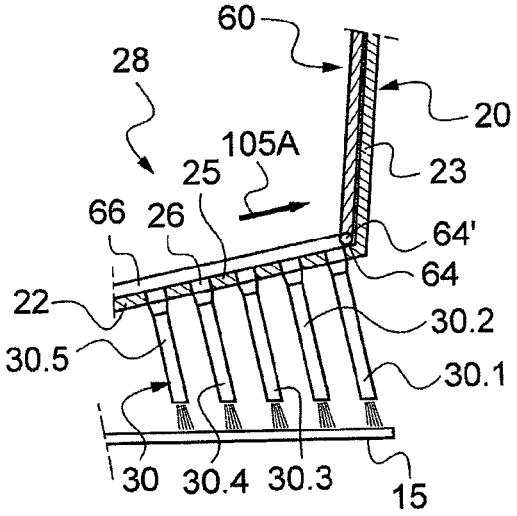
Fig.8A
Fig.8B
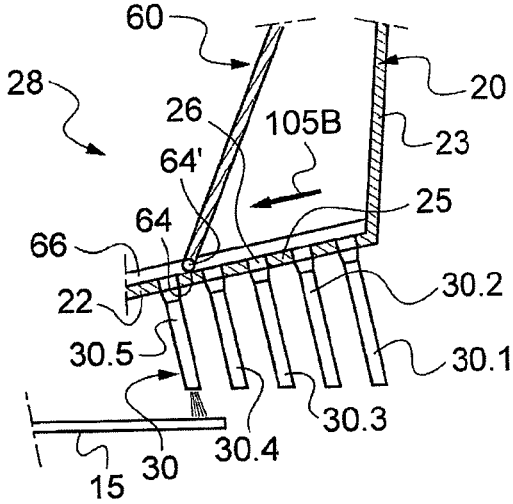

DEVICE FOR BLOWING GAS ONTO A FACE OF TRAVELING STRIP MATERIAL

The present invention relates to a device for blowing gas on a surface of traveling strip material.

The invention relates most particularly to lines for processing steel or aluminum strip making use of at least one chamber for cooling by means of gas jets, or a section for cooling by means of gas jets, such as heat treatment lines, in particular lines for performing continuous annealing, or such as coating lines, in particular galvanizating lines. The treatment lines concerned may equally well require gas to be blown in order to preheat strips, as occurs for chromating treatment with metal strips being annealed, during which a protective varnish is deposited and dried by blowing hot air.

Nevertheless, the invention is not limited to the above-specified field of use, and it relates more generally to blowing gas onto a surface of traveling strip material that need not necessarily be a metal material, e.g. it could be paper or plastics material, in order to perform drying or cooling or coating treatment, as required.

BACKGROUND OF THE INVENTION

It has been known for a long time to make use of devices for blowing gas onto one or both faces of a traveling metal strip, in particular in order to cool it.

Reference may thus be made to documents U.S. Pat. No. 3,116,788 and U.S. Pat. No. 3,262,688 which describe different systems for blowing gas from hollow boxes or tubular hollow elements disposed in the longitudinal direction of the strip or in a direction extending transversely to the strip travel direction. Those documents teach using jets of gas that are inclined relative to the normal to the plane of the traveling strip in order to improve the stability of the strip as it travels.

More recently, as described in document WO-A-01/09397, proposals have been made to channel the stream of blown gas by providing boxes fitted with blow tubes, with the blow tubes inclined towards the edges of the strip, mainly for the purpose of avoiding vibration in the traveling strip while it is being cooled by blowing jets of gas.

Document U.S. Pat. No. 6,054,095 also teaches inclining blow tubes fitted to the boxes towards the edges of the strip, the arrangement of the blow tubes being selected to obtain better temperature uniformity of the strip.

The various documents mentioned above seeking to improve temperature uniformity of the strip in a transverse direction are of interest, but without in any way solving the problems that arise in the zone of the free margins of the traveling strip.

These problems are both thermal, insofar as edge effects make it difficult to obtain uniform temperature, and also aerodynamic, insofar as the jets of gas blown from the two boxes disposed on either side of the traveling strip create turbulence that disturbs both the stability of the strip and the uniformity of the atmosphere in the vicinity of the free margins of said traveling strip.

The above-mentioned problems become more complicated when there are changes in strip format, in particular in strip width.

When changing from a wide strip to a narrower strip, it is naturally advantageous to be in a position, supposing this is possible, to limit the blowing of gas in the marginal zones between which traveling strip no longer passes.

In an attempt to solve that problem, proposals have already been made to subdivide the inside of the box and its feed pipe, by arranging stationary partitions to define inside spaces having downstream ends located at the inlets of the tubular nozzles for injecting gas. The upstream end of each of said inside spaces receives a flow rate regulator member, e.g. of the rotary valve type. Under such circumstances, if the two valves associated with the spaces that open out in the margins are closed and if the other valves are opened, then blowing occurs only in the central outlet zone from the hollow box. Nevertheless, in practice such a system is found to be very constraining because it is very frequent that a strip lies astride two adjacent spaces, such that it is always necessary to open the extreme valve, while it is traveling, since the strip may move as much as 100 millimeters (mm) on either side of its central position, in a transverse direction. Thus, if it is desired to preserve good uniformity of cooling, it is necessary to ensure that the blow width is always excessive, and consequently it is necessary to run at a flow rate that is abnormally high compared with the genuine requirements for blowing gas.

The above-mentioned system with valves and compartments has also been used to generate different blowing forces across the width of the traveling strip, in order to be able to cause the strip to be inclined so as to obtain stability that is improved to a greater or lesser extent. Different blowing rates have also been used to generate strong blowing forces at the ends and weaker blowing forces in the center of the traveling strip, thereby making it possible to avoid dishing of said strip and prevent it from touching the boxes or the blow nozzles.

Proposals have also been made to use that valve and compartmenting system to adjust the transverse uniformization of the traveling strip by blowing more or less strongly against the strip. Under such circumstances, adjustment is performed manually and monitored by a pyrometric scanner.

Document JP-61 257429 A describes a set of two blow boxes with a steel strip for cooling traveling between them. The active face of each box presents through slots for blowing a cooling gas, and said face is fitted internally with two lateral flaps pivoting thereon, plane on plane, so as to vary the width of the slots in the travel direction of the strip, said width decreasing in the travel direction of said strip so as to exert cooling that is progressively more energetic in the central portion of the strip. It should be observed that both of the pivoting lateral flaps are secured to the active face of the box and that the edges of said flaps are always oblique relative to the travel direction of the strip. There is therefore no question of adjusting the width of the material, but only of varying the width of the cooling zone for a given width of strip.

Adapting to the width of the strip is disclosed in document JP 57-171626 A for cooling with water. In that document, the (sole) cooling box is fitted with spray nozzles having their inlets selectively fed by means of two pistons that can be moved transversely.

Such adaptation is also to be found in document GB-2 096 490 A using movable transverse sliders associated with slots for projecting a cooling liquid.

Document JP-58 185 717 A illustrates a system with screens (FIG. 5) serving to vary the width of the cooling zone on either side of an orthogonal midplane of the strip, but in association with boxes that can be inclined.

Document JP-63 077564A shows a complex system with transversely-movable sliders serving to feed the fluid injection nozzles selectively in order to take account of the width of the strip in question.

Finally, document DE-31 46 656 A describes a cooling tube having removable seals suitable for taking account of the strip in question.

There is thus a need for a device that is more flexible, in particular that is capable of responding easily and accurately during changes of strip width, and if possible of improving the gas blowing performance.

OBJECT OF THE INVENTION

The invention seeks to propose a gas blow device that does not present the drawbacks and/or limitations of the above-mentioned prior systems, and that is in particular well adapted to changes in the widths of the traveling strips that are to be treated, while optimizing simultaneously the thermal and the air flow aspects, and to do so in an installation that is of a cost that remains reasonable.

The invention also seeks to propose a blow device that provides greater flexibility in terms of gas flow rate, avoiding delivering excessive amounts of gas compared with the real requirements for blowing gas.

GENERAL DESCRIPTION OF THE INVENTION

The above-mentioned technical problem is solved in accordance with the invention by a device for blowing gas on a face of traveling strip material, the device comprising at least one hollow box having its wall facing towards the corresponding face of the strip material fitted with a plurality of blow orifices enabling gas to be directed towards said face of the strip material, the hollow box also being fitted laterally on at least one side thereof relative to a midplane perpendicular to the plane in the strip with a movable shutter member having the function of selectively shutting some of the blow orifices in order to adapt the width of the blow zone to the width of the corresponding strip material, said movable shutter member having an edge adjacent to the inside surface of the wall fitted with the blow orifices, and an edge adjacent to a side wall of the hollow box.

Preferably, the edges of the movable shutter member are and remain essentially parallel to the travel direction of the strip.

Thus, the movable shutter member may be moved freely as a function of needs, and in particular as a function of strips having different widths.

Indeed in this respect, it should be observed that the widths of strips generally lie in the range 400 mm to 2200 mm, but that only 30% to 40% of a year's worth of orders relates to strips of maximum width. Consequently, since the flow rate that is genuinely required is less for narrower strip widths, the fact of retaining the same flow rate with a narrower strip makes it possible to increase the travel speed of the strip, thereby further improving production capacities.

In a particular embodiment, the movable shutter member is a flap that is rigid in its plane.

The flap might be a pivoting flap, or a flap that is movable in translation in a lateral direction in the vicinity of and parallel to the inside surface of the wall fitted with the blow orifices, said flap then passing through a slot in the side wall of the hollow box.

In a variant, provision may be made for the movable shutter member to be a deformable flap that bears against the inside surface of the wall fitted with the blow orifices and against the inside surface of a side wall of the hollow box.

It may also be advantageous to make provision for the flap constituting the movable shutter member to be guided in its movement by slideways in which wheels coupled to said flap travel.

In general, provision may be made for the shutter member to be moved from one position to the other by the action of mechanical and/or electrical and/or hydraulic means, such as actuators or rack systems.

Advantageously, the hollow box is fitted on both sides thereof with respective movable shutter members.

In accordance with a particularly advantageous embodiment, for a device having two hollow boxes between which the strip material is to travel so that the blown gas is applied simultaneously to both faces of the traveling strip, it is then advantageous to make provision for each of the two hollow boxes to be fitted with at least one movable shutter member, the movable shutter members facing each other.

Also advantageously, the gas blow device includes a plurality of movable shutter members with the individual movements thereof being controlled by a common central unit.

The blow device may have its blow orifices constituted by tubular nozzles projecting at least in part outside the corresponding wall of the hollow box, the movable shutter member then being arranged to shut off selectively the inlets of some of the tubular nozzles.

In a variant, the blow device may have its blow orifices constituted by holes through the corresponding wall of the hollow box, the movable shutter member then being arranged to shut off selectively the inlets or the outlets of some of the holes.

Other characteristics and advantages of the invention appear more clearly in the light of the following description and of the accompanying drawings.

BRIEF DESCRIPTION OF THE DRAWINGS

Reference is made below to the figures of the accompanying drawings, in which:

FIGS. 7A and 7B are fragmentary section views showing the operation of a movable shutter flap of the type shown in FIGS. 1 and 2, with an example of associated control means, here in the form of a rack and pinion, the views showing respectively the maximum opening position and the maximum closing position of the movable shutter flap; and FIGS. 8A and 8B show in the same manner a flap of the type shown in FIGS. 3 and 4, respectively in a maximum opening position and a maximum closing position.

DETAILED DESCRIPTION OF A PREFERRED EMBODIMENT OF THE INVENTION

Figure 1:
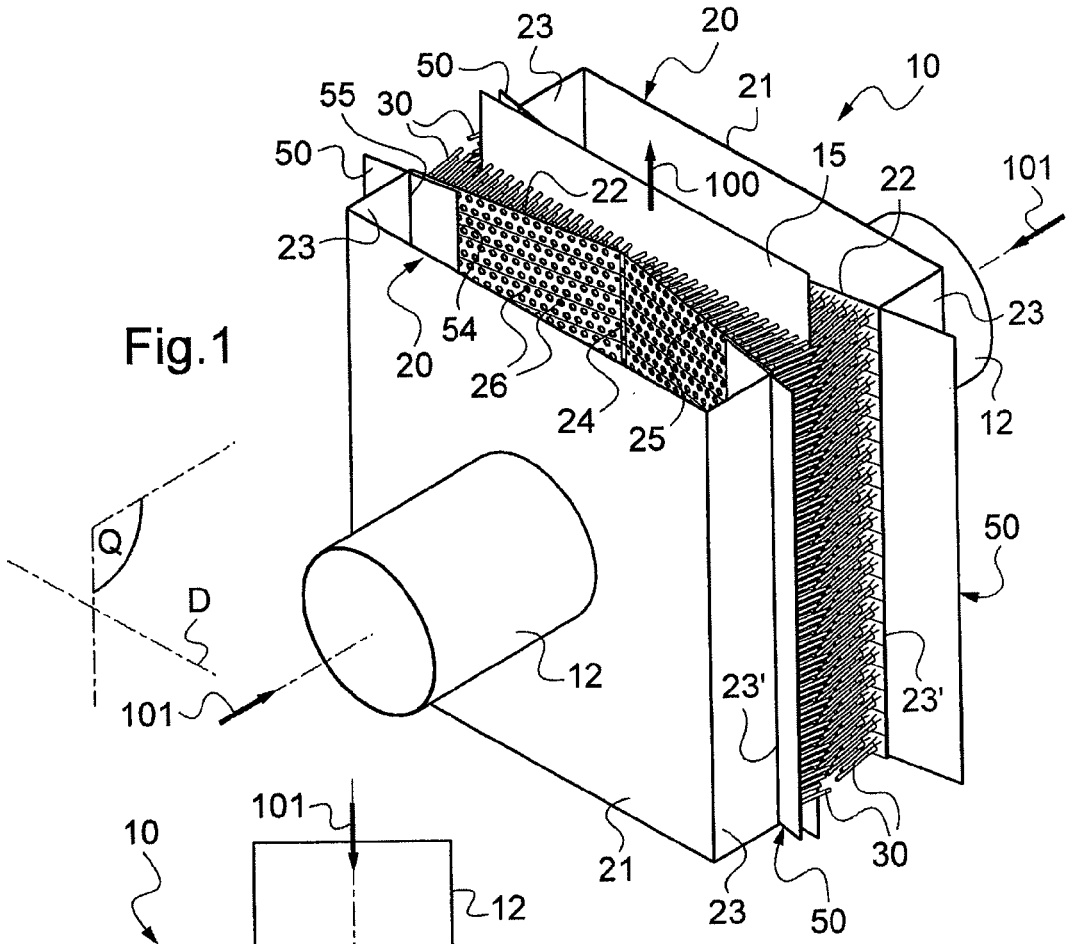
FIG. 1 is a perspective view of a gas blow device in accordance with the invention, here comprising two hollow boxes between which strip material travels, each hollow box here being fitted laterally, on both sides, with a movable shutter flap, and each shutter flap is movable in translation in a lateral direction.
Figure 2:
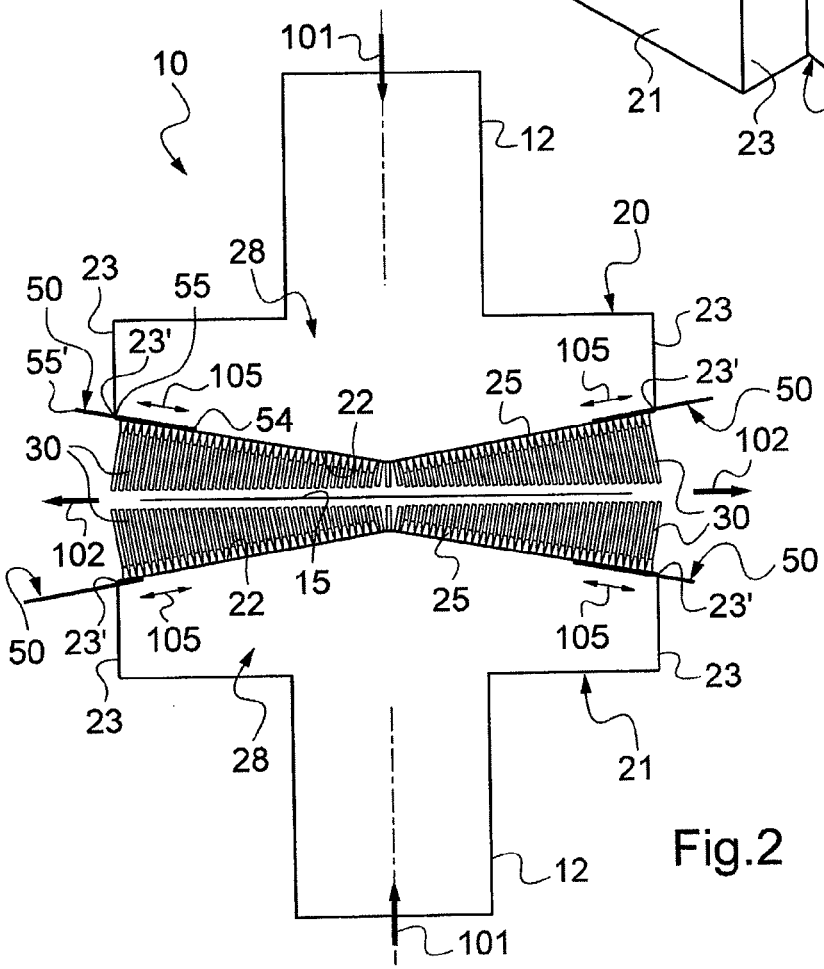
FIG. 2 is a section of the FIG. 1 device on its midplane Q containing its central axis, the figure showing more clearly the four movable shutter flaps.

FIGS. 1 and 2 show a portion of a blow installation including a gas blow device in accordance with the invention given overall reference 10.

On either side of traveling strip material referenced 15, the travel direction being symbolized by an arrow 100, the device 10 comprises a respective hollow box 20 with the strip material 15 traveling between the two facing boxes 20.

Each hollow box 20, of inside space referenced 28, comprises a rear wall 21 to which a blowing gas admission tube 12 is connected, the blow gas feed being symbolized by an arrow 101, a front or active wall 22 opposite from the wall 21, and facing towards the corresponding face of the strip material 15, together with two side walls 23.

The wall 22 of each hollow box is fitted with a plurality of blow orifices serving to direct the gas towards the corresponding face of the strip material 15. Specifically, the blow orifices are constituted by tubular nozzles 30 projecting at least in part from the wall 22, but in a variant provision could be made for the blow orifices to be constituted by holes in said wall 22 (variant not shown).

In addition, the wall 22 of each hollow box presents a profile that is variable in a direction D extending transversely relative to the travel direction 100 of the strip material 15, and symmetrically relative to a midplane Q perpendicular to the plane of the strip 15, said profile being arranged to present a V-shaped dihedral with its ridge referenced 24. This is naturally no more than an example seeking to obtain particular advantages, in particular advantages inherent to the nozzle effect obtained by the planes that diverge outwards on either side, as represented by arrows 102 in FIG. 2, and it is equally possible to provide a wall 22 of plane structure, as in the conventional configurations in this field.

In accordance with an essential characteristic of the invention, each hollow box 20 is also fitted laterally on at least one side thereof (here on both sides) relative to the midplane Q that is perpendicular to the plane of the strip 15 with a moving shutter member having the function of selectively shutting off some of the blow orifices, and specifically for shutting off the inlets of some of the tubular nozzles 30, in order to adapt the width of the blow zone to the width of the strip material 15 in question, said moving member having one edge adjacent to the inside surface 25 of the wall 22 that has the blow orifices, and one edge adjacent to a side wall 23 of the hollow box 20.

Thus, it suffices to modify the position of the movable shutter member to shut off selectively a marginal zone, and consequently easily and quickly adapt to any possible width of strip.

Preferably, the edges of the movable shutter member are and remain essentially parallel to the travel direction of the strip, thus guaranteeing a good match with different widths of strip.

In FIGS. 1 and 2, a movable shutter member is provided in the form of a flap 50 that is rigid in its own plane. The flap 50 is movable in translation in a lateral direction, as represented in FIG. 2 by arrows 105, in the vicinity of and parallel to the inside surface 25 of the wall 22 carrying the tubular nozzles 30.

FIGS. 7A and 7B show clearly how such movable shutter members operate.

In these figures, there can be seen the movable shutter member 50 having one edge 54 inside the hollow box 20 that is adjacent to the surface 25 of the wall 22 having the blow orifices, and having its opposite edge 55, that passes through an associated slot 23' in the side wall 23 of said box thus lying adjacent to said side wall, with the other end 55' of said flap then remaining outside said box. These figures show diagrammatically an example of a mechanism for actuating the movable shutter flap 50, said means given reference 51 being implemented in the form of a rack and pinion system with a rack 52 fastened to the movable flap 50 and a pinion 53 carried by an outlet shaft of a driving motor (not shown) having its casing secured to the stationary structure of the blow installation. In a variant, it is possible to provide a hydraulic actuator system, or more generally any type of appropriate mechanical and/or electrical and/or hydraulic means.

In FIGS. 7A and 7B, there can be seen the inlet 26 to each of the tubular nozzles 30, these tubular nozzles being referenced 30.1 to 30.5 in order to explain the invention.

In FIG. 7A, the flap 50 is in its maximally-disengaged position, such that all of the nozzles 30.1 to 30.5 are subjected to the blowing gas. This position corresponds to a strip of maximum width. Arrow 105A indicates that the flap is in its maximally-disengaged open position.

In FIG. 7B, there can be seen the position in which the shutter flap 50 is maximally pushed in, a position in which the outermost nozzles 30.1 to 30.4 have their inlets 26 shut off, while the inlet to the nozzle 30.5 remains disengaged, such that only the nozzle 30.5, and naturally all the following nozzles going towards the midplane Q, are subjected to the blowing. This position corresponds to the narrowest width of strip. Arrow 105B is there to indicate that the movable shutter flap 50 is in its maximum shutting position.

Figure 3:
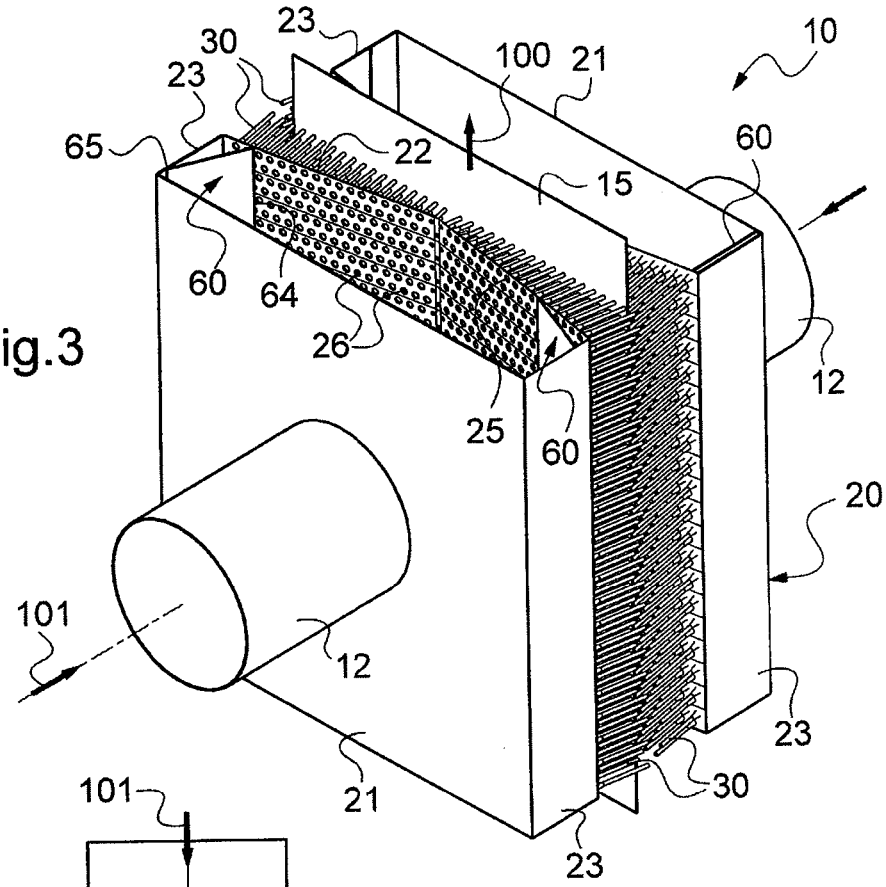
FIGS. 3 and 4 are analogous to FIGS. 1 and 2 and show a variant in which the movable shutter flaps are arranged to move in pivoting to go from one position to another.
Figure 4:
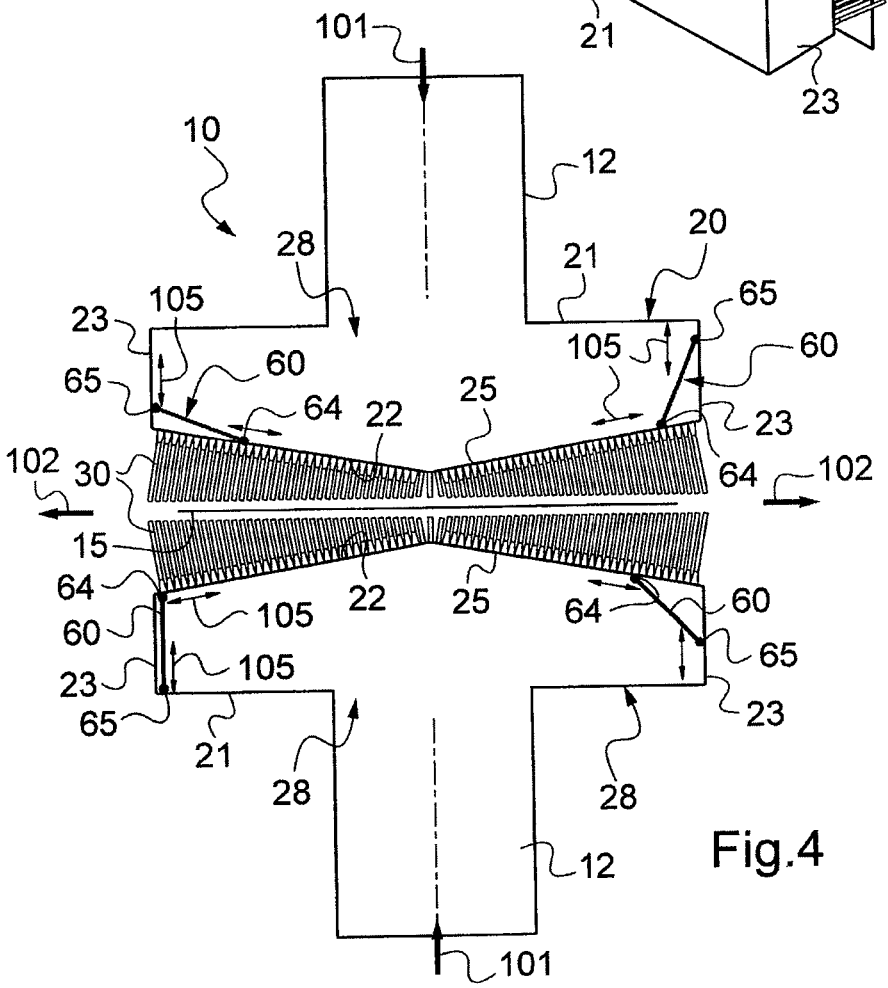

FIGS. 3 and 4 show a variant in which the rigid flap referenced 60 moves somewhat differently than in the above-described embodiment. The flap 60 is pivotally mounted, having one edge 64 adjacent to the inside surface 25 of the wall 22 carrying the tubular nozzles 30, and an edge 65 adjacent to the inside surface of a side wall 23 of the hollow box 20.

Reference can be made to FIGS. 8A and 8B for a better understanding of how such an embodiment works.

In FIGS. 8A and 8B, there can be seen guide means for preventing the movable shutter flap 60 from jamming while it moves with end wheels 64' traveling in slideways 66.

In FIG. 8A, the inlets 26 to all of the tubular nozzles 30.1 to 30.5 are disengaged, whereas in FIG. 8B, the inlets 26 of tubular nozzles 30.1 to 30.4 are shut off, while the inlet to the tubular nozzle 30.5 is disengaged. This produces the same effect as in the preceding embodiment.

Figure 5:
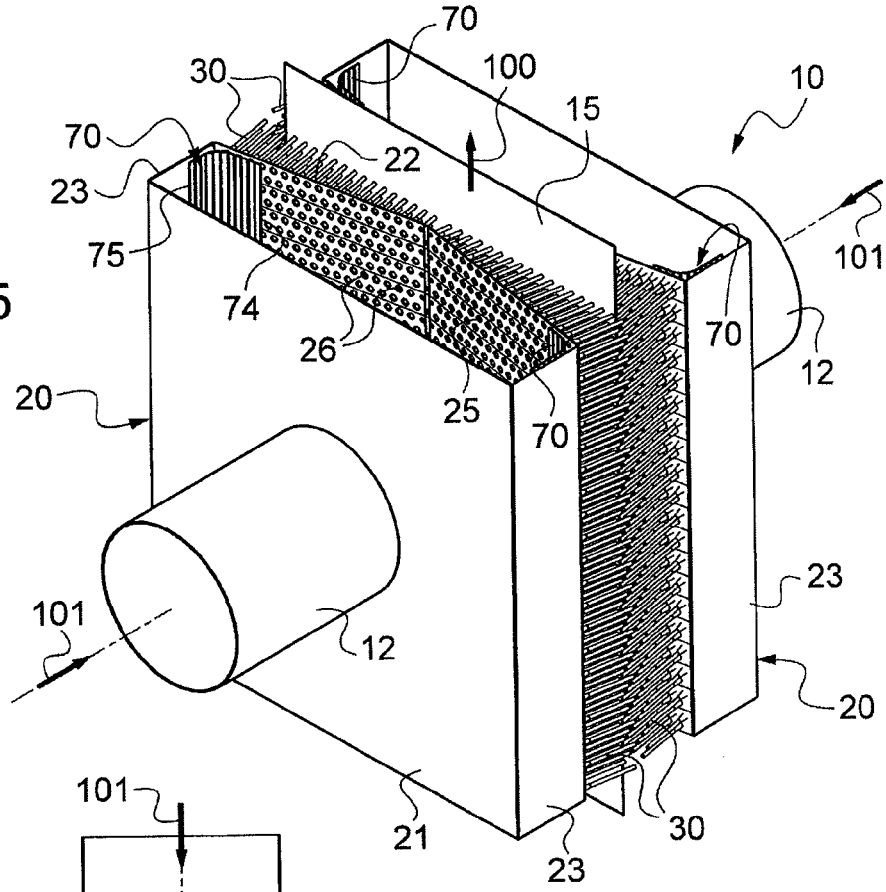
FIGS. 5 and 6, analogous to the above figures, show another variant in which the movable shutter member is a deformable flap.
Figure 6:
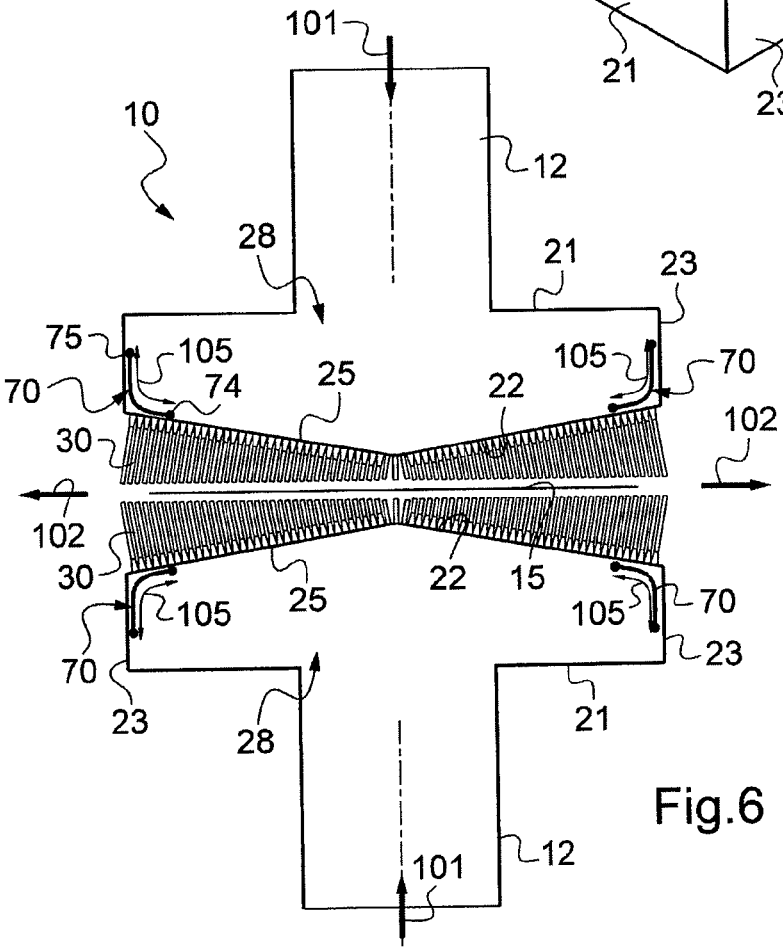

FIGS. 5 and 6 show yet another variant in which the movable flap referenced 70 is a deformable flap, e.g. hinged like a blind, which flap bears against the inside surface 25 of the wall 22 carrying the lateral nozzles 30 and against the inside surface of a side wall 23 of the hollow box 20. Once more, one edge 74 of the flap 70 rests adjacent to the inside surface 25 while the other edge 75 remains adjacent to the side wall 23.

The slideway system shown in FIGS. 8A and 8B could naturally be envisaged for the variant of FIGS. 1 & 2 and 5 & 6.

In practice, with a plurality of movable shutter members 50, 60, 70, the individual movement of each of these movable shutter members is preferably controlled by a common central unit (not shown here) that is connected to the center for controlling the process.

As mentioned above, the edge 54, 64, 74 of each movable shutter member 50, 60, 70 is and remains parallel to the travel direction 100 of the strip.

This thus provides a gas blow device with particularly high performance, thus making it easy and quick to adapt the width of the blow zone to the width of the strip material in question.

Furthermore, in the event of certain blow orifices being shut off, a flow rate is delivered that is greater than that strictly necessary, thereby enabling performance to be further improved, in particular by increasing the travel speed of the strip.

The invention is not limited to the embodiments described above, but on the contrary covers any variant using equivalent means to reproduce the essential characteristics as specified above.

In particular, it is possible to arrange the blow orifices not in the form of tubular nozzles, but rather in the form of holes through the wall in question of the hollow box (variant not shown), in which case the movable shutter member is arranged to shut off selectively the inlets (member inside the box) or the outlets (member outside the box) of some of the holes, having the same width-adapting effect as described above for tubular nozzles.

It is also possible to use hollow boxes that are arranged otherwise, in particular tubular boxes.

Finally, it should be understood that the invention is usable equally well for a strip traveling vertically as for a strip traveling horizontally.

The invention claimed is:

1. A device for blowing gas on a face of traveling strip material, the device comprising:

at least one hollow box defined by at least one side wall and a wall facing towards a corresponding face of the strip material fitted with a plurality of blow orifices enabling gas to be directed towards said face of the strip material, wherein the hollow box is also fitted laterally on at least one side thereof relative to a midplane (Q) perpendicular to a plane in the strip with a movable shutter member having a function of selectively shutting some of the blow orifices in order to adapt a width of the blow zone to a width of a corresponding strip material, wherein said movable shutter passes through a slot that extends through a side wall of the hollow box, such that said movable shutter is movable, via said slot, in translation in a lateral direction in a vicinity of and parallel to the inside surface of the wall fitted with the blow orifices.

2. The gas blow device according to claim 1, wherein the edges of the movable shutter member are and remain essentially parallel to the travel direction of the strip.

3. The gas blow device according to claim 1, wherein the movable shutter member is a flap that is rigid in its plane.

4. A device for blowing gas on a face of traveling strip material, the device comprising:

at least one hollow box having its wall facing towards the corresponding face of the strip material fitted with a plurality of blow orifices enabling gas to be directed towards said face of the strip material, wherein the hollow box is also fitted laterally on at least one side thereof relative to a midplane (Q) perpendicular to a plane in the strip with a movable shutter member having a function of selectively shutting some of the blow orifices in order to adapt a width of the blow zone to a width of a corresponding strip material, said movable shutter member having an edge adjacent to an inside surface of the wall fitted with the blow orifices, and an edge adjacent to a side wall of the hollow box, and wherein the movable shutter member is a deformable flap that bears against the inside surface of the wall fitted with the blow orifices and against the inside surface of a side wall of the hollow box.

5. The gas blow device according to claim 2, wherein the flap constituting the movable shutter member is guided in its movement by slideways in which wheels coupled to said flap travel.

6. The gas blow device according to claim 2, wherein the shutter member is moved from one position to the other by the action of mechanical and/or electrical and/or hydraulic means, such as actuators or rack systems.

7. The gas blow device according to claim 1, wherein the hollow box is fitted on both sides thereof with respective movable shutter members.

8. The gas blow device according to claim 1, comprising two hollow boxes between which the strip material is to travel so that the blown gas is applied simultaneously to both faces of the traveling strip, wherein each of the two hollow boxes is fitted with at least one movable shutter member, the movable shutter members facing each other.

9. The gas blow device according to claim 1, having a plurality of movable shutter members with the individual movements thereof being controlled by a common central unit.

10. The gas blow device according to claim 1, in which the blow orifices are constituted by tubular nozzles projecting at least in part outside the corresponding wall of the hollow box, wherein the movable shutter member is arranged to shut off selectively the inlets of some of the tubular nozzles.

11. The gas blow device according to claim 1, in which the blow orifices are constituted by holes through the corresponding wall of the hollow box, wherein the movable shutter member is arranged to shut off selectively the inlets or the outlets of some of the holes.

* * * * *